US005325775A

United States Patent [19]

Grosshauser et al.

[11] Patent Number: 5,325,775

[45] Date of Patent: Jul. 5, 1994

[54] CHAMBERED DOCTOR BLADE

[75] Inventors: Heinrich K. Grosshauser; Reinhold R. Dürr, both of Würzberg; Thomas Kübert, Karlstadt-Karlburg, all of Fed. Rep. of Germany

[73] Assignee: Koenig & Bauer Aktiengesellschaft, Wurzburg, Fed. Rep. of Germany

[21] Appl. No.: 466

[22] Filed: Jan. 5, 1993

[30] Foreign Application Priority Data

Jan. 15, 1992 [DE] Fed. Rep. of Germany ..... 4200837

[51] Int. Cl.[5] ..... B41F 31/04; B41F 31/06

[52] U.S. Cl. ..... 101/366; 101/169

[58] Field of Search ..... 101/366, 365, 157, 169, 101/350, 363, 364, 207, 208, 209, 210

[56] References Cited

U.S. PATENT DOCUMENTS 4,158,333 5/1978 Navi .
4,834,018 5/1989 Sollinger et al. .
4,873,939 11/1989 Eskelinen .
4,920,913 7/1988 Knop et al. .
4,958,561 11/1988 Grosshauser et al. .
5,054,392 10/1991 Greenwood ..... 101/366

FOREIGN PATENT DOCUMENTS 3320305 6/1983 Fed. Rep. of Germany .
3438380 10/1984 Fed. Rep. of Germany .
3446757 12/1984 Fed. Rep. of Germany .
3737531 11/1987 Fed. Rep. of Germany .
3738658 11/1987 Fed. Rep. of Germany .

*Primary Examiner*—J. Reed Fisher
*Attorney, Agent, or Firm*—Jones, Tullar & Cooper

[57] ABSTRACT

A chambered doctor blade for a short inking unit of a rotary press includes an ink receiving chamber and a profiled body positioned in the chamber. The shapes of the profiled body and the ink receiving chamber are complementary and define an ink flow path. This path is tapered in the direction of ink flow and provides a forced circulation of the ink through the tapered flow path.

4 Claims, 1 Drawing Sheet

CHAMBERED DOCTOR BLADE

FIELD OF THE INVENTION

The present invention is directed generally to a chambered doctor blade. More particularly, the present invention is directed to a chambered doctor blade for a short inking unit. Most specifically, the present invention is directed to a chambered doctor blade for a short inking unit of a rotary printing press. The chambered doctor blade utilizes a base plate and a pair of spaced, axially extending doctor blades and holders to define an ink receiving chamber. A profiled body or bar is located in the ink receiving chamber of the doctor blade. This profiled bar is spaced from the inner surfaces of the elements which form the ink receiving chamber. The spacing width decreases in the direction of ink flow through the chambered doctor blade between an ink supply opening and an ink outlet opening.

DESCRIPTION OF THE PRIOR ART

Chambered doctor blade assemblies for short inking units of rotary printing presses are generally known in the art. Devices of this type utilize a chamber which extends axially parallel to, and spaced from the surface of a rotating screened surface ink roller. Ink is supplied to the chamber and is applied to the surface of the roller. A pair of spaced, axially extending doctor blades are employed to engage the surface of the screened surface roller and to limit the amount of ink applied to the roller from the chamber.

In the German published, unexamined patent application No. 37 37 531 A1, which corresponds to U.S. Pat. No. 4,958,561 there is shown an inking bar for a short inking unit. In this device there is provided a profiled body which is situated in the ink distributing chamber in the inking bar. This profile bar is pivotably or rotatably carried in the ink distributing chamber so that the pressure between its surface and a cooperating surface of the screened surface ink fountain roller can be varied. With this assembly there is the possibility that an accumulation of water and air can occur in the ink chamber. This accumulation of water and air may reduce the effectiveness of the inking bar and may result in faults in the image printed by the printing unit with which this inking bar is associated.

In U.S. Pat. No. 4,158,333 there is disclosed an inking unit in which an ink reservoir is in contact with a screened surface ink roller. The ink reservoir is provided with baffle plates that are utilized to eliminate turbulence in the ink contained in the ink reservoir. These baffle plates are arranged parallel to each other in the axial direction of the screened surface ink roller. They divide the ink reservoir into a plurality of chambers that are linked to each other.

A limitation of this prior art inking unit is that it does not provide for any separation for the water that is carried into the ink reservoir by the screened surface ink roller. There is also no provision for the creation of an external pressure which is needed to fill the cells of the screened surface ink roller.

It will be seen that a need exists for a chambered doctor blade that overcomes the limitations of the prior art devices. The chambered doctor blade in accordance with the present invention provides such a device and is a significant improvement over the prior art devices.

SUMMARY OF THE INVENTION

It is an object of the present invention to provide a chambered doctor blade.

Another object of the present invention is to provide a chambered doctor blade for a short inking unit.

A further object of the present invention is to provide a chambered doctor blade for a short inking unit of a rotary press.

Yet another object of the present invention is to provide a chambered doctor blade having an ink receiving chamber which includes a profiled bar.

Still a further object of the present invention is to provide a chambered doctor blade in which the profiled bar defines a tapering flow path for the ink.

Even yet another object of the present invention is to provide a chambered doctor blade in which the ink is circulated and is discharged after one circulation through the tapering flow path.

As will be discussed in greater detail in the description of the preferred embodiment which is set forth subsequently, the chambered doctor blade for a short inking unit in accordance with the present invention utilizes a base plate and spaced doctor blade holders and associated doctor blades, in cooperation with a surface of a screened ink roller to define an ink receiving chamber. This chamber is provided with an ink supply channel and an ink outlet channel. A profiled bar or body is secured to the ink chamber base plate and is shaped to cooperate with the various ink chamber defining components to form an ink flow path that extends from the ink supply channel to the ink outlet channel. This ink flow channel has a cross-sectional width that tapers down or reduces in the direction of ink flow from the ink supply to the ink outlet.

A primary advantage of the chambered doctor blade of the present invention is its ability to provide a forced ink circulation of the ink-water emulsion in the ink chamber. This forced circulation is a result of the decreasing width or tapering width of the ink flow path around the profiled body or bar that is secured in the ink chamber. This forced circulation virtually eliminates any turbulent flow areas or other flow disturbances that could result in the creation of ink deposits which are supplemented by unwanted additions of air or water. The forced flow or circulation of the ink is uniform along the homogeneous axially extending gap and is free of turbulence. The ink transferred to the screened ink roller from the chambered doctor blade is uniform in character so that a consistent print quality is obtained.

The chambered doctor blade of the present invention overcomes the limitations of the prior art devices. The chambered doctor blade thus is a substantial advance in the art.

BRIEF DESCRIPTION OF THE DRAWINGS

While the novel features of the chambered doctor blade in accordance with the present invention are set forth with particularity in the appended claims, a full and complete understanding of the invention may be had by referring to the detailed description of the preferred embodiment which is presented subsequently, and as illustrated in the accompanying drawings, in which:

DESCRIPTION OF THE PREFERRED EMBODIMENT

Figure 1:
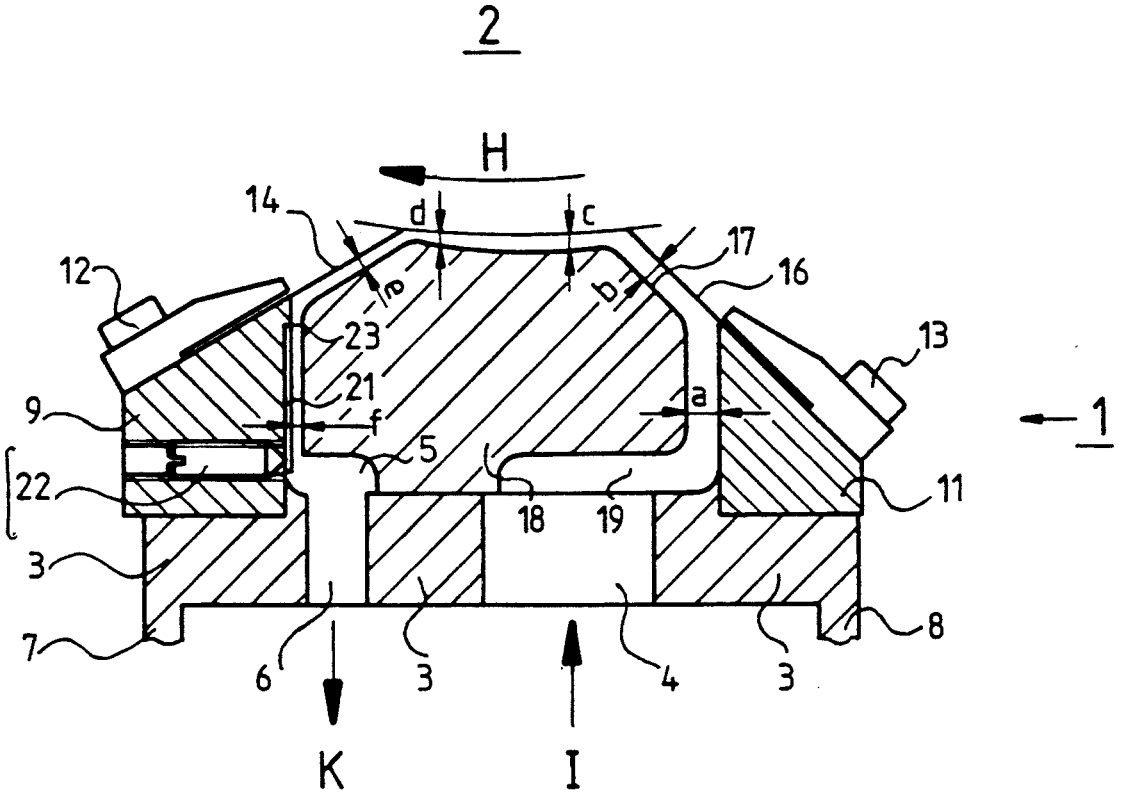
FIG. 1 is a cross-sectional view through a chambered doctor blade in accordance with the present invention.

Referring initially to FIG. 1, there may be seen generally at 1 a chambered doctor blade for a short inking unit of a rotary press in accordance with the present invention. The chambered doctor blade 1 cooperates with a screened ink roller, which is depicted somewhat schematically at 2 in FIG. 1, and which rotates about an axially extending axis of rotation in the direction of rotation indicated by the arrow H. The supports for the screened ink roller and the supports and associated ancillary elements of the short inking unit and the rotary printing press with which the chambered doctor blade of the present invention is associated are not specifically depicted in FIG. 1 since they are generally conventional.

Referring again to FIG. 1 the chambered doctor blade 1 utilizes a generally flat, rectangular base plate 3 which is sized to be cooperative with the screened ink roller 2. An ink supply opening or channel 4 is formed in the base plate 3 as is an ink outlet opening or channel 6. It will be understood that the ink supply and outlet openings 4 and 6, respectively are joined to suitable ink supply and discharge lines (not shown) so that a supply of ink or an ink and water emulsion will be supplied to the chambered doctor blade 1 and any unused ink or emulsion will be removed.

Doctor blade base plate 3 is provided with a pair of spaced, axially extending support bars 7 and 8 on its undersurface. These support bars 7 and 8, which extend parallel to the axis of rotation of the screened ink roller 2 are used to support the chambered doctor blade 1 in a suitable manner so that it can be thrown-on and thrown-off the screened ink roller 2. The specific supporting structure is not depicted in FIG. 1 since it is generally well-known and forms no part of the present invention.

A pair of elongated doctor blade holders 9 and 11 are provided on the upper surface of the base plate 3 of the chambered doctor blade 1. These doctor blade holders 9 and 11 are positioned along the longitudinal edges of the base plate 3 and extend parallel to the axis of rotation of the screened ink roller 2. The doctor blade holder 9, which is downstream in the direction of rotation of the screened ink roller 2 carries a stripping-off blade 14 whereas the upstream doctor blade holder 11 supports a sealing blade 16. Suitable fastening screws 12 and 13 are used to secure the doctor blades 14 and 16 in their separate holders 9 and 11.

The base plate 3, doctor blade holders 9 and 11, doctor blades 14 and 16, and the surface of the screened ink roller 2 all cooperate to define an ink receiving chamber in the chambered doctor blade. A profiled body or bar 17 in accordance with the present invention is positioned in this ink receiving chamber. The profiled body 17 extends in the ink receiving chamber in the axial direction of the screened ink roller 2. A foot bar portion 18 of the profiled bar 17 is secured to the base plate 3 by suitable fastening means, such as screws which are not specifically depicted. It will be understood that the profiled body 17 can be adjustable in the horizontal as well as in the vertical directions on the base plate 3 by providing generally known adjusting devices between the base plate 3 and the profiled body 17.

Profiled body 17 is shaped to provide an ink supply chamber at 19 which overlies the ink supply opening 4 in the base plate 3. Similarly, an ink outlet chamber 5 is formed between the profiled body 17 and the ink outlet opening 6 in the base plate 3. Ink or an ink and water emulsion is supplied to the supply chamber 19 in the direction indicated by the arrow I, and flows through a flow path which will be discussed below. Any ink that is not removed from the flow path by the screened ink roller 2 is returned in the direction of the arrow K to a suitable ink reservoir which is not depicted in the drawings.

Figure 2:
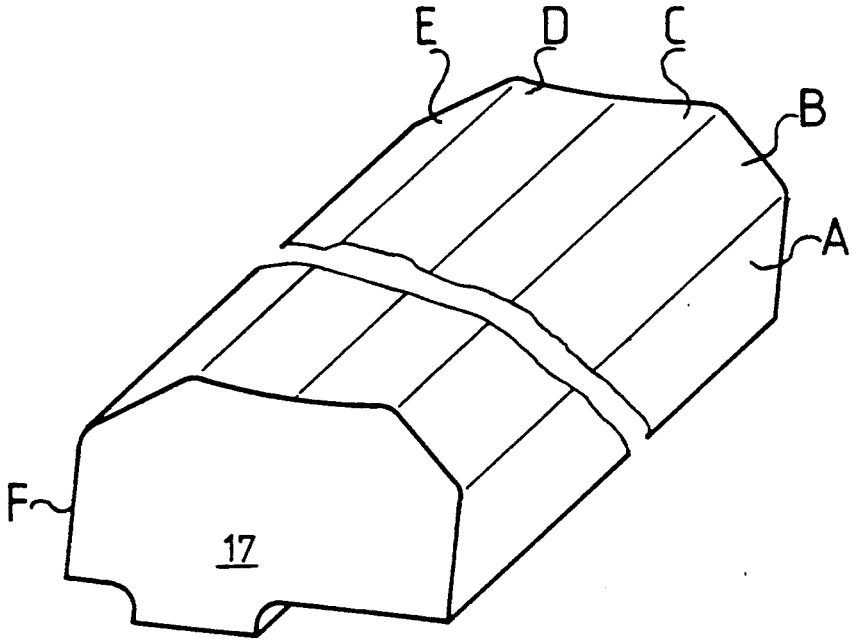
FIG. 2 is a perspective view of the profiled bar or body which is positioned in the ink receiving chamber of the chambered doctor blade of the present invention.

The profiled body 17 has, as may be seen most clearly in FIG. 2, a plurality of outer peripheral surfaces A, B, C, D, E and F. Each of these peripheral surfaces extends axially along the length of the profiled body 17. Further, each profiled body peripheral surface A, B, C, D, or E corresponds in shape with a cooperating surface of elements 11, 16, 2, 14, 9 and 21. Thus the cross-sectional profile of the profiled body 17 is generally concentric or complementary with, and smaller than the cross-sectional profile of the ink receiving chamber.

The placement of the profiled body 17 in the ink receiving chamber defines a flow path which has a cross-sectional area that is reducing or tapers in the direction of ink flow from the supply chamber 19 to the outlet chamber 5. The ink enters the taper gap or space in an area "a" between the peripheral surface A of the ink profiled body 17 and the doctor blade holder 11. The next taper gap or space is depicted as "b" in FIG. 1 and is the space between the peripheral surface B of the profiled body 17 and the sealing doctor blade 16. The taper gaps "c" and "d" are the spaces between the peripheral surface C of the profiled body 17 and the surface of the screened ink roller 2. The taper area "e" is the space between the peripheral surface E of the profiled body 17 and the stripping off blade A. The taper area "f" is the space between the peripheral surface F of the profiled body 17 and the doctor blade holder 9 and an adjustable baffle plate 21 which forms a part of the doctor blade holder 9.

In the chambered doctor blade 1 of the present invention, the gap widths of the taper areas "a" to "f" are preferably within the following ranges:

| | |
|---|---|
| a | 4 to 6 mm |
| b | 3 to 5 mm |
| c | 2 to 3 mm |
| d | 1 to 2 mm |
| e | 1 to 2 mm |
| f | less than 2 mm |

The taper gap or area "f" is adjustable by means of the baffle plate 21 which was referred to previously. As may be seen in FIG. 1, baffle plate 21 forms a portion of the side wall of the doctor blade holder 9. An upper end 23 of baffle plate 21 is secured to the inner surface of the doctor blade holder 9 by welding or the like. The baffle plate is flexible and its free end can be moved toward or away from peripheral surface F of the profiled body 17 by means of suitable set screws 22. Movement of the free end of the baffle plate 21 toward the peripheral surface F of the profiled body 17 reduces the width of the taper gap "f".

In operation, a supply of ink or an ink-water emulsion is directed to the supply chamber 19. This ink is caused to flow under pressure through the tapered flow channel defined by taper gaps "a", "b", "c", "d", "e" and "f". The ink is used to fill the recesses in the screened ink roller 2 as it passes by peripheral surfaces C and D of the profiled body 17. Any ink which is not carried away by the screened surface roller 2 flows through the reducing taper flow gap to the outlet chamber 5 and through the outlet opening 6 in the base plate 3. It will thus be seen that the ink travel path in the chambered doctor blade 1 of the present invention is in a flow path which has a reducing tapered cross-sectional flow area in the direction of ink flow from the ink supply chamber 19 to the ink outlet chamber 5. The flow of ink is a forced circulation in which there can be no areas of turbulence or the like. All the ink flows through the tapered flow path in the same direction and is discharged after one circulation. Thus the ink will not become contaminated or diluted.

While a preferred embodiment of a chambered doctor blade for a short inking unit in a rotary press has been set forth fully and completely hereinabove, it will be apparent to one of skill in the art that a number of changes in, for example the size of the screened ink roller, the ink supply and discharge reservoirs, the materials used and the like may be made without departing from the true spirit and scope of the present invention which is accordingly to be limited only by the following claims.

What is claimed is:

1. A chambered doctor blade for a short inking unit of a rotary press, said chambered doctor blade comprising:

a base plate having an ink supply opening and an ink outlet opening;

first and second spaced doctor blade holders positioned in said base plate, said first doctor blade holder having an inner surface adjacent said ink outlet opening;

first and second doctor blades in said first and second doctor blade holders;

a screened ink roller having an ink receiving surface;

an ink receiving chamber in said chambered doctor blade;

a profiled body secured in said ink receiving chamber, said profiled body defining a tapered ink flow path in said ink receiving chamber, said tapered ink flow path reducing in flow area from said ink supply opening to said ink outlet opening; and a baffle plate carried on said inner surface of said first doctor blade holder and facing said profiled body, said baffle plate having a first end secured to said first doctor blade holder and a second end whose position with respect to said profiled body is adjustable.

2. The chambered doctor blade of claim 1 wherein said profiled body has a foot bar which is secured to said base plate.

3. The chambered doctor blade of claim 1 wherein said ink receiving chamber is defined by surfaces of said first and second doctor blade holders, said first and second doctor blades and said ink receiving surface of said screened ink roller and further wherein said profiled body has a plurality of peripheral surfaces, said surfaces of said ink receiving chamber and said peripheral surfaces of said profiled body defining said tapered ink flow path.

4. The chambered doctor blade of claim 1 wherein said profiled body is movably secured to said base plate.

* * * * *